US008733118B2

(12) United States Patent
Ushijima et al.

(10) Patent No.: US 8,733,118 B2
(45) Date of Patent: May 27, 2014

(54) HEAT PUMP WATER HEATER OUTDOOR UNIT AND HEAT PUMP WATER HEATER

(75) Inventors: Takahiro Ushijima, Tokyo (JP); Kazuki Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1144 days.

(21) Appl. No.: 12/360,456

(22) Filed: Jan. 27, 2009

(65) Prior Publication Data

US 2009/0199581 A1 Aug. 13, 2009

(30) Foreign Application Priority Data

Feb. 7, 2008 (JP) ..... 2008-027941

(51) Int. Cl.
*F25B 27/00* (2006.01)

(52) U.S. Cl.
USPC ..... 62/238.7; 62/159; 62/324.6

(58) Field of Classification Search
USPC ..... 62/159–160, 238.7, 324.6
See application file for complete search history.

(56) References Cited

U.S. PATENT DOCUMENTS

| | | | | |
|---|---|---|---|---|
| 5,052,472 | A * | 10/1991 | Takahashi et al. | 165/299 |
| 5,555,737 | A * | 9/1996 | Takeo et al. | 62/230 |
| 5,669,231 | A * | 9/1997 | Itoh et al. | 62/210 |
| 5,737,931 | A * | 4/1998 | Ueno et al. | 62/126 |
| 5,778,691 | A * | 7/1998 | Suzuki et al. | 62/160 |
| 6,343,482 | B1 * | 2/2002 | Endo et al. | 62/324.6 |
| 6,481,234 | B2 * | 11/2002 | Ma et al. | 62/160 |
| 6,718,781 | B2 * | 4/2004 | Freund et al. | 62/513 |
| 8,109,105 | B2 * | 2/2012 | Unezaki et al. | 62/222 |
| 2009/0071177 | A1 | 3/2009 | Unezaki et al. | |

FOREIGN PATENT DOCUMENTS

| | | | |
|---|---|---|---|
| EP | 1 647 783 | A2 | 4/2006 |
| EP | 1 696 188 | A2 | 8/2006 |
| JP | A-2001-355928 | | 12/2001 |
| JP | 2006-112708 | A | 4/2006 |
| JP | 2006-112753 | A | 4/2006 |
| JP | 2006-258343 | A | 9/2006 |

(Continued)

OTHER PUBLICATIONS

Unezaki et al., Apr. 2006, Machine Translation of Detailed Description of JP-2006-112708.*
Abstract of JP 2006-153349.*

(Continued)

*Primary Examiner* — Lakiya Rogers
*Assistant Examiner* — Orlando E Aviles Bosques
(74) *Attorney, Agent, or Firm* — Posz Law Group, PLC

(57) ABSTRACT

To provide a heat pump water heater outdoor unit and heat pump water heater capable of preventing reduction in heating/hot water supply ability even at a low ambient temperature. A heat pump water heater outdoor unit, in which a compressor, a water heat exchanger, a first expansion valve, and an air heat exchanger are connected with piping, includes a first internal heat exchanger provided between the water heat exchanger and the first expansion valve and used for heat exchange between a refrigerant flowing between the water heat exchanger and the first expansion valve and a refrigerant flowing between the air heat exchanger and the compressor, an injection circuit branching off at a point between the first internal heat exchanger and the first expansion valve and to inject the refrigerant into the compressor through a second expansion valve; and a second internal heat exchanger for heat exchange between the refrigerant flowing between the first internal heat exchanger and the first expansion valve and the refrigerant flowing between the second expansion valve and the compressor in the injection circuit.

19 Claims, 2 Drawing Sheets

(56) References Cited

FOREIGN PATENT DOCUMENTS

| | | | |
|---|---|---|---|
| JP | 2007-132628 | A | 5/2007 |
| JP | A-2007-278686 | | 10/2007 |
| WO | 20071046812 | A2 | 4/2007 |
| WO | 2007/110908 | A1 | 10/2007 |

OTHER PUBLICATIONS

Office Action mailed Jan. 17, 2012 issued in corresponding JP application No. 2008-027941 (and English translation).
Extended European Search Report dated Apr. 11, 2013 issued in corresponding EP patent application No. 09001177.6-1605.

* cited by examiner

HEAT PUMP WATER HEATER OUTDOOR UNIT AND HEAT PUMP WATER HEATER

BACKGROUND OF THE INVENTION

1. Field of the Invention

The present invention relates to a heat pump water heater outdoor unit and more specifically to a heat pump water heater outdoor unit in which a refrigerant is injected during a compressing process to improve an ability to supply high-temperature water and a heating ability at a low ambient temperature, and a heat pump water heater equipped with the heat pump water heater outdoor unit.

2. Description of the Related Art

A heat pump utilizing heat energy in air has been used for a water heater or an air conditioner as an energy-saving heat source. In the case of running the heat pump water heater or air conditioner in a high-temperature (for example, 60° C.) water supply mode or a quick heating mode at low temperatures (for example, −15° C.), an evaporation temperature of an evaporator decreases. Therefore, if a refrigerant is compressed to a predetermined pressure, a temperature of the refrigerant discharged from a compressor increases. At this time, an overtemperature protection function for a discharge refrigerant temperature is performed to ensure a reliability of the compressor, to thereby decrease a capacity (number of revolution) of the compressor. This causes a problem of decreasing an operating ability (a heating/hot water supply ability of the water heater or a heating ability of the air conditioner).

To solve the above problem, as a mechanism for injecting a refrigerant during a compressing process of a compressor, for example, the following air conditioner is proposed (for example, in Japanese Unexamined Patent Application Publication No. 2006-112753). The air conditioner is constituted such that it comprises an outdoor unit 1 incorporates a compressor 3, a four-way valve 4 for switching between a heating mode and a cooling mode, an outdoor heat exchanger 12, a first expansion valve 11 as a first decompression device, a second internal heat exchanger 10, a third expansion valve 8 as a third decompression device, an injection circuit 13, a second expansion valve 14 as a second decompression device, an intermediate-pressure receiver 9, and a refrigerant heating heat source 17; a suction pipe 18 of the compressor 3 passes through the intermediate-pressure receiver 9, so that a refrigerant in a through pipe 18*a* of the suction pipe 18 and a heat exchange refrigerant 9*a* in the intermediate-pressure receiver 9 can exchange heat; and in addition, the refrigerant heating heat source 17 heats a refrigerant flowing through the injection circuit.

Further, for example, the following air conditioner is proposed (for example, in Japanese Unexamined Patent Application Publication No. 2006-258343). The air conditioner includes a main refrigerant circuit 20 (hereinafter also referred to as "main refrigerant pipe") constituted by connecting an injection-port-equipped compressor 1, a four-way valve 2, an indoor heat exchanger 3, a first expansion value 4, an supercooling heat exchanger 5, a second expansion valve 6, and an outdoor heat exchanger 7 in sequence, and a first bypassing circuit 21 constituting an injection circuit extending from a point between the second expansion value 6 and the supercooling heat exchanger 5 to an injection port of the compressor 1 through a third expansion value 8, the supercooling heat exchanger 5, a refrigerant heating unit 9 and a first opening/closing valve 10".

Further, for example, the following heat pump water heater is proposed (for example, in Japanese Unexamined Patent Application Publication No. 2007-132628). The water heater is mainly composed of a hot water storage circuit 1K including a hot water cylinder, a circulation pump, and a heating heat exchanger, which are connected into circularly with hot water piping, a hot water supply circuit 2K for supplying hot water in the hot water cylinder to a target portion, a refrigerant circuit R including a compressor capable of adjusting a compression power in two stages, the heating heat exchanger, a cooling device, a first electric expansion valve, and an evaporator, which are connected circularly with refrigerant piping, and an intermediate injection circuit M that branches off from the refrigerant circuit at a point between the heating heat exchanger and the cooling device, and is provided with an electromagnetic opening/closing valve, a second electric expansion valve, and the cooling device and configured to cause a part of the refrigerant discharged from the heating heat exchanger to flow back to a portion between a low-pressure side and a high-pressure side of the compressor".

However, Japanese Unexamined Patent Application Publication Nos. 2006-112753 and 2006-258343 that disclose the air conditioner equipped with the injection circuit describe only advantages or control processes applicable for the air conditioner equipped with the injection circuit, but not describe advantages or control processes for a heat pump water heater equipped with a water heat exchanger. Thus, the disclosed air conditioner cannot be easily applied to a heat pump water heater with a higher load and larger load change than the air conditioner.

Further, a conventional heat pump water heater (for example, see Japanese Unexamined Patent Application Publication No. 2007-132628) has no function of stabilizing a refrigerant condition in a water heat exchanger (condenser in a heating/hot water supply mode), which varies along with a load change of the water heat exchanger, and has a problem of an unstable heat exchange performance of the water heat exchanger.

SUMMARY OF THE INVENTION

The present invention has been accomplished with a view to solving the above problems. Accordingly, it is a first object of the present invention to provide a heat pump water heater outdoor unit and a heat pump water heater capable of preventing a heating/hot water supply ability from decreasing even at a low ambient temperature. It is a second object of the present invention to provide a heat pump water heater outdoor unit and heat pump water heater capable of stabilizing a refrigerant condition in a water heat exchanger even at the time when a load of the water heat exchanger varies, and ensuring a high heat exchange performance of the water heat exchanger.

The present invention provides a heat pump water heater outdoor unit, in which a compressor, a water heat exchanger for exchanging heat between water and a refrigerant, a first decompression device, and an air heat exchanger for exchanging heat between air and the refrigerant are connected circularly with piping, to supply heat absorbed from the air by means of the refrigerant flowing through the air heat exchanger, to the water flowing through the water heat exchanger by means of the refrigerant flowing through the water heat exchanger, including: a first internal heat exchanger provided between the water heat exchanger and the first decompression device and used for exchanging heat between the refrigerant flowing between the water heat exchanger and the first decompression device and the refrigerant flowing between the air heat exchanger and the compressor; an injection circuit branching off at a point between the first internal heat exchanger and the first decompression device for injecting a refrigerant into a compressor through a second decompression device; and a second internal heat exchanger for exchanging heat between the refrigerant flowing between the first internal heat exchanger and the first decompression device and the refrigerant flowing between the second decompression device and the compressor in the injection circuit.

According to the present invention, the compressor is provided with the injection circuit for injecting the refrigerant into the compressor and thus, even a heat pump water heater outdoor unit involving a high load and a large load change can be prevented from decreasing its heating/hot water supply ability at a low ambient temperature.

DESCRIPTION OF THE PREFERRED EMBODIMENTS

Embodiment

Figure 1:
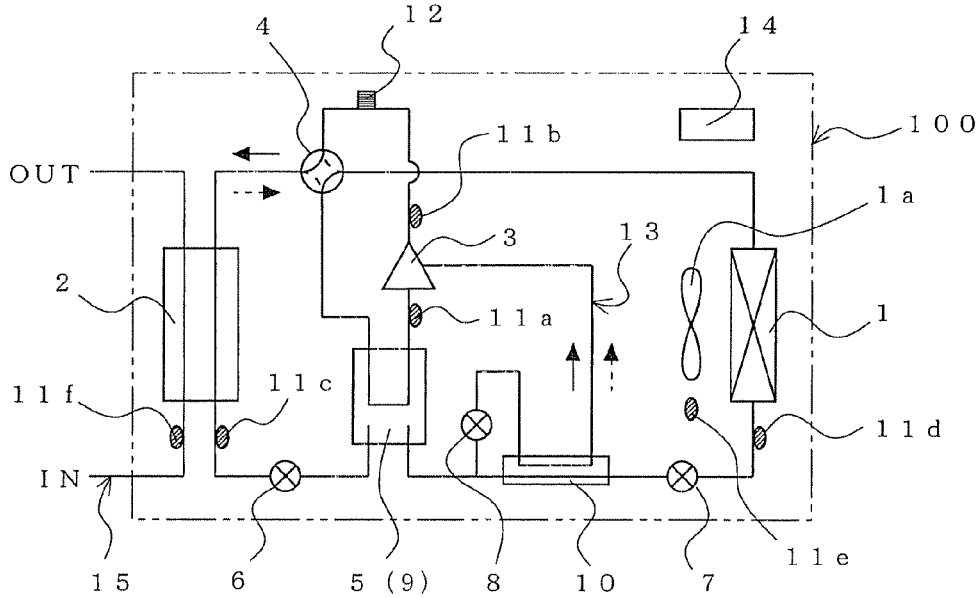
FIG. 1 shows an example of a refrigerant circuit of a heat pump water heater outdoor unit according to an embodiment of the present invention.

FIG. 1 shows an example of a refrigerant circuit of a heat pump water heater outdoor unit according to an embodiment of the present invention.

A refrigeration cycle circuit of a heat pump water heater outdoor unit 100 is constituted by a compressor 3, a four-way valve 4 for switching refrigerant flow directions for a heating/hot water supply mode and a defrosting mode, a water heat exchanger 2 for exchanging heat between water and a refrigerant, a third expansion valve 6 for adjusting a flow rate of the refrigerant and reducing its pressure, an intermediate-pressure receiver 5, a first expansion valve 7 for adjusting a flow rate of the refrigerant and reducing its pressure, an air heat exchanger 1 for heat exchange between the air and the refrigerant, an injection circuit 13, a second expansion valve 8 for adjusting a flow rate of the refrigerant and reducing its pressure, and a second internal heat exchanger 10, which are connected with piping. Here, the first expansion valve 7 corresponds to a first decompression device of the present invention, the second expansion valve 8 corresponds to a second decompression device of the present invention, and the third expansion valve 6 corresponds to a third decompression device of the present invention.

A suction pipe of the compressor 3 passes through the intermediate-pressure receiver 5, the refrigerant in the thorough pipe portion of the suction pipe can exchange heat with the refrigerant in the intermediate-pressure receiver 5, and the intermediate-pressure receiver 5 functions as a first internal heat exchanger 9.

The compressor 3 is structured such that its number of revolution is controlled by an inverter to control its capacity, and the refrigerant can be supplied into a compression chamber in the compressor 3 from the injection circuit 13. The third expansion valve 6, the first expansion valve 7, and the second expansion valve 8 are electric expansion valves the opening degree of which can be controlled variably. The water heat exchanger 2 exchanges heat between refrigerant and water flowing through a water pipe 15 connected to a hot water tank (not shown). The air heat exchanger 1 exchanges heat between refrigerant and the air supplied with a fan la or the like. As for a refrigerant for the heat pump water heater outdoor unit, a non-azeotropic refrigerant mixture such as R407C, a pseudo-azeotropic refrigerant mixture such as R410A, and a single refrigerant such as R22, and the like can be used.

Further, the heat pump water heater outdoor unit 100 is provided with temperature sensors 11*a* to 11*f*, a pressure sensor 12, and a control device 14. The first temperature sensor 11*a* is provided at a suction side of the compressor 3 to measure a suction temperature of the compressor 3. The second temperature sensor 11*b* is provided at a discharge side of the compressor 3 to measure a discharge temperature of the compressor 3. The third temperature sensor 11*c* is provided between the water heat exchanger 2 and the third expansion valve 6 to measure a temperature of the refrigerant flowing from the water heat exchanger 2 in the heating/hot water supply mode. The fourth temperature sensor 11*d* is provided between the first expansion valve 7 and the air heat exchanger 1 to measure a temperature of the refrigerant flowing into the water heat exchanger 2 in the heating/hot water supply mode. The fifth temperature sensor 11*e* measures an ambient temperature around the outdoor unit. The sixth temperature sensor 11*f* is provided at a water inflow side of the water heat exchanger 2 to measure a temperature of inflow water of the water heat exchanger 2.

Here, the first temperature sensor 11*a* corresponds to an intake refrigerant temperature sensor of the present invention, the second temperature sensor 11*b* corresponds to a discharge refrigerant temperature sensor of the present invention, the third temperature sensor 11*c* corresponds to a condenser liquid refrigerant temperature sensor of the present invention, the fourth temperature sensor 11*d* corresponds to an evaporator liquid refrigerant temperature sensor of the present invention, the fifth temperature sensor 11*e* corresponds to an ambient temperature sensor of the present invention, and the sixth temperature sensor 11*f* corresponds to an inflow water temperature sensor of the present invention.

The pressure sensor 12 is provided between the compressor 3 and the four-way valve 4 to detect a pressure of the refrigerant discharged from the compressor 3. Here, since the piping between the pressure sensor 12 and the water heat exchanger 2 or the air heat exchanger 1 is short, a pressure loss is small. Therefore, a pressure detected by the pressure sensor 12 is almost equal to a condensation pressure of the refrigerant in the water heat exchanger 2 in the heating/hot water supply mode or a condensation pressure of the refrigerant in the water heat exchanger 2 in the defrosting mode. A condensing temperature of the refrigerant can be calculated based on the condensation pressure.

The control device 14 controls an operation process of the compressor 3, a process for switching a flow path of the four-way valve 4, an amount of the air supplied from a fan of the air heat exchanger 1, and opening degrees of the third expansion valve 6, the first expansion valve 7, and the second expansion valve 8 based on temperature measured with the temperature sensors 11*a* to 11*f* provided in the heat pump water heater outdoor unit 100, a pressure detected by the pressure sensor 12, and an operation mode designated by an operator of the heat pump water heater outdoor unit. Here, the control device 14 may be provided outside the heat pump water heater outdoor unit 100.

Figure 2:
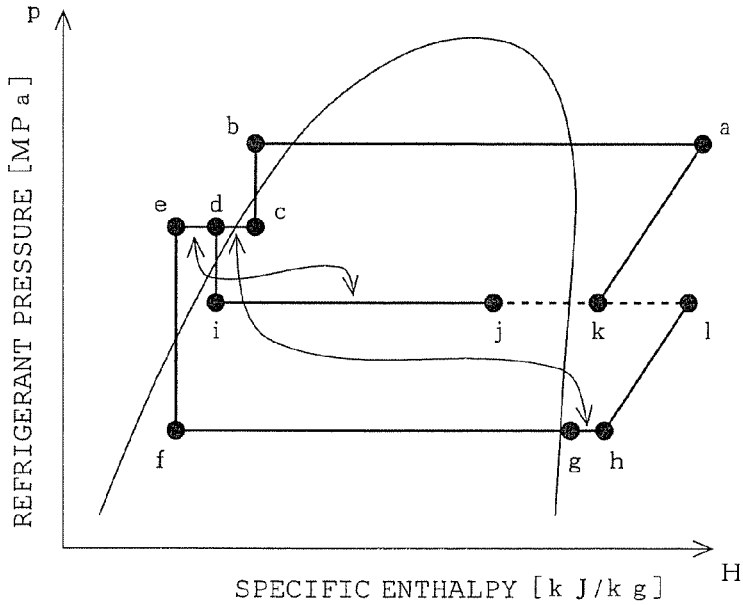
FIG. 2 is a P-h diagram showing operation of a refrigeration cycle in a heating/hot water supply mode of the heat pump water heater outdoor unit according to the embodiment.

Subsequently, a refrigeration cycle operation of the heat pump water heater outdoor unit 100 in the heating/hot water supply mode is described. In the following example, a refrigerant is injected to the compressor 3. FIG. 2 is a P-h diagram showing the refrigeration cycle operation in the heating/hot water supply mode of the heat pump water heater outdoor unit 100. The abscissa axis represents a specific enthalpy [kJ/kg], and the ordinate axis represents a refrigerant pressure [MPa]. Referring to FIG. 2 as well as FIG. 1, the refrigeration cycle in the heating/hot water supply mode is described.

In the heating/hot water supply mode, a flow path of the four-way valve 4 is set to a direction indicated by the solid line of FIG. 1. A high temperature/high pressure gas refrigerant (state a) discharged from the compressor 3 flows into the water heat exchanger 2 through the four-way valve 4. Then, the refrigerant is condensed and liquefied by radiating heat in the water heat exchanger 2 functioning as a condenser and turned into a high pressure/low temperature liquid refrigerant (state b). At this time, water flowing through the water pipe 15 is warmed with the heat radiated from the refrigerant. The high pressure/low temperature refrigerant flowing out of the water heat exchanger 2 is slightly decompressed by the third expansion valve 6 (state c) and then turned into a liquid-vapor refrigerant to flow into the intermediate-pressure receiver 5 (first internal heat exchanger). Then, the refrigerant exchanges heat with a low-temperature refrigerant at the suction side of the compressor 3 in the intermediate-pressure receiver 5 and then cooled (state d), and flows out of the intermediate-pressure receiver 5 in the form of liquid refrigerant.

The liquid refrigerant flowing out of the intermediate-pressure receiver 5 is partially supplied to the injection circuit 13 but is mainly supplied to the second internal heat exchanger 10. In the second internal heat exchanger 10, the mainly supplied portion of the liquid refrigerant (stated) exchanges heat with a refrigerant that has branched off into the injection circuit 13 and is decompressed with the second expansion valve 8 to reduce the temperature, and thus is further cooled (state e). Then, the refrigerant is decompressed down to a low pressure with the first expansion valve 7 and turned into a two-phase refrigerant (state f) to flow into the air heat exchanger 1. In the air heat exchanger 1, the refrigerant absorbs heat from the outside air supplied from the fan 1*a* and evaporates. Then, the refrigerant is turned into a low-pressure gas refrigerant (state g). After that, the refrigerant passes through the four-way valve 4, exchanges heat with a high-pressure refrigerant, in the intermediate-pressure receiver 5, and is further heated (state h) and sucked into the compressor 3.

On the other hand, the refrigerant branching off into the injection circuit 13 (state d) is decompressed down to an intermediate pressure by the second expansion valve 8 and turned into a low-temperature two-phase refrigerant (state i). Then, the refrigerant flows into the second internal heat exchanger 10 and is heated by the mainly supplied high-pressure liquid refrigerant (state j). After that, the refrigerant is injected into the compressor 3.

The compressor 3 sucks the low-temperature gas refrigerant (state h) heated in the intermediate-pressure receiver 5, compresses it to an intermediate pressure and heats it (state l). Thereafter, the compresser 3 sucks the refrigerant (state j) injected from the injection circuit 13 to mix the two refrigerants (state k). After that, a pressure of the resultant refrigerant is increased to a high pressure and the refrigerant is discharged (state a).

Figure 3:
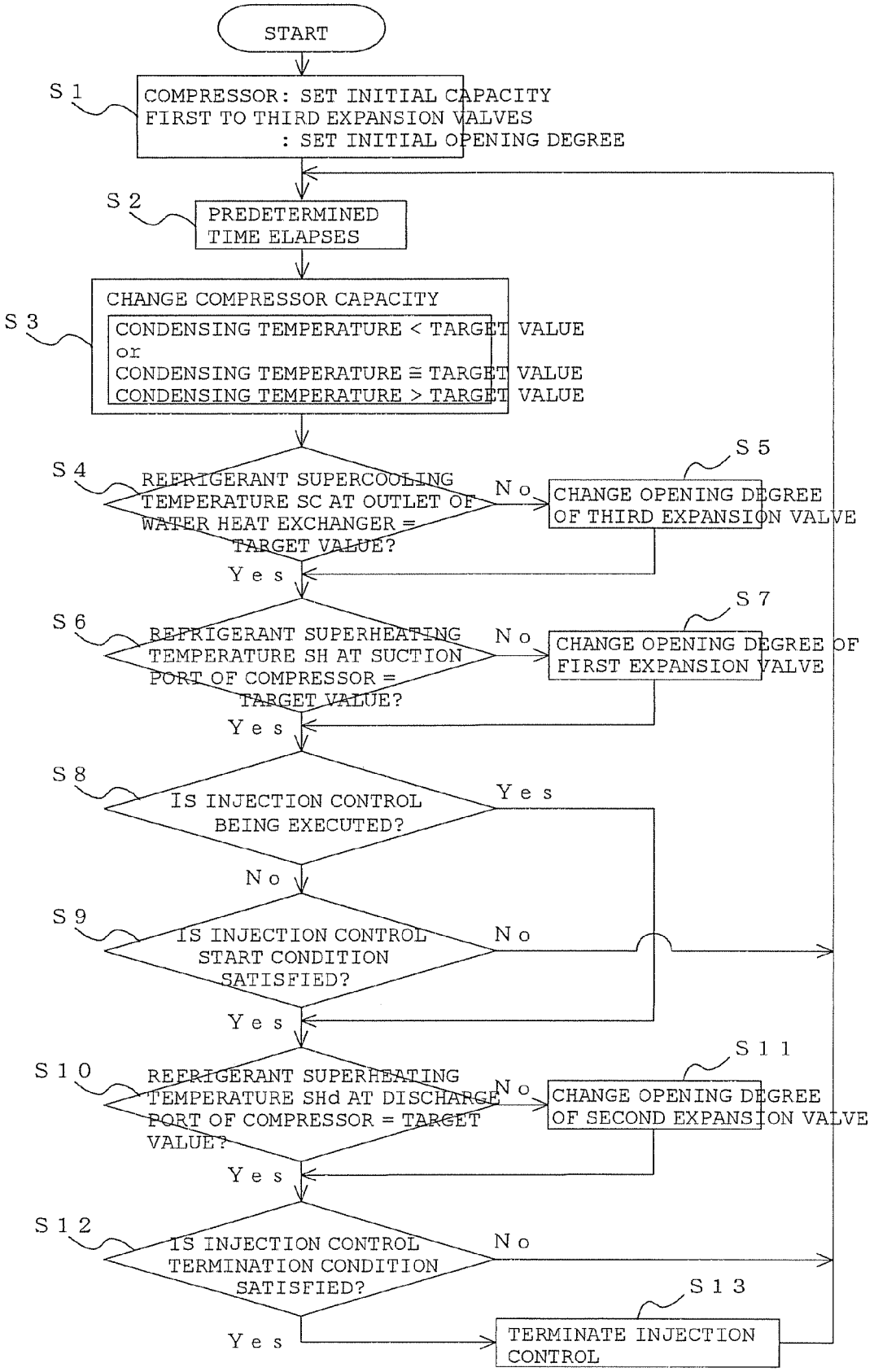
FIG. 3 is a flowchart showing control operation in the heating/hot water supply mode of the heat pump water heater outdoor unit according to the embodiment.

Next, an operation control on the heat pump water heater outdoor unit 100 in the heating/hot water supply mode is described. FIG. 3 is a flowchart showing a control operation in the heating/hot water supply mode of the heat pump water heater outdoor unit 100. If a user's instruction to start an operation in a heating/hot water supply mode is received, a capacity of the compressor 3, and opening degrees of the third expansion valve 6, the first expansion valve 7, and the second expansion valve 8 are first set to initial values, in step S1. After the elapse of a predetermined time in step S2, each actuator is controlled as follows according to an operation condition.

In step S3, a capacity of the compressor 3 is changed. The heat pump water heater outdoor unit 100 makes water stored in a how water tank (not shown) circulate through the water pipe 15 and the water heat exchanger 2 with a circulation pump or the like (not shown) to thereby heat the water. This circulating operation is repeated until the water temperature reaches a preset temperature specified by a user, for example. Here, the temperature of the circulating water is determined depending on the condensing temperature of the water heat exchanger 2 and thus, a target condensing temperature of the water heat exchanger 2 is determined to be the preset water temperature. Accordingly, a capacity of the compressor 3 is controlled based on the target condensing temperature of the water heat exchanger 2, which is calculated based on a discharged refrigerant pressure of the compressor 3 detected by the pressure sensor 12, and the target condensing temperature of the water heat exchanger 2, which is determined based on the preset water temperature.

More specifically, in step S3, the condensing temperature of the water heat exchanger 2, which is calculated from the discharged refrigerant pressure of the compressor detected by the pressure sensor 12, is compared with the target condensing temperature of the water heat exchanger 2, which is determined based on the preset water temperature. If the condensing temperature of the water heat exchanger 2 is lower than the target condensing temperature and a difference between the condensing temperature of the water heat exchanger 2 and the target condensing temperature is large, an operation frequency of the compressor 3 is increased (a capacity of the compressor 3 is increased). To be specific, an amount of a refrigerant circulating in the refrigeration cycle is increased so as to quickly adjust the condensing temperature of the water heat exchanger 2 to be close to the target condensing temperature. Thereby, a heat exchange ability of the water heat exchanger 2 is increased. Then, the processing advances to step 4.

Further, if the condensing temperature of the water heat exchanger 2 is lower than the target condensing temperature and a difference between the condensing temperature of the water heat exchanger 2 and the target condensing temperature is small, an operation frequency of the compressor 3 is decreased (the capacity of the compressor 3 is decreased). To be specific, an amount of a refrigerant circulating in the refrigeration cycle is decreased to lower the heat exchange ability of the water heat exchanger 2. Then, the processing advances to step S4.

In step S4, the condensing temperature that is calculated based on a refrigerant supercooling degree SC at the outlet of the water heat exchanger 2 (a differential temperature between the condensing temperature calculated based on the pressure of the refrigerant discharged from the compressor 3, which is detected by the pressure sensor 12 and the temperature of the refrigerant at the outlet of the water heat exchanger 2, which is measured by the third temperature sensor 11*c*) is compared with a target value to determine whether to change the opening degree of the third expansion valve 6. The third expansion valve 6 is controlled such that the refrigerant supercooling degree SC at the outlet of the water heat exchanger 2 is kept at a preset target value. Accordingly, if the refrigerant supercooling degree SC at the outlet of the water heat exchanger 2 is equal or close to the target value, the opening degree of the third expansion valve 6 is not changed and the processing advances to step S6. If the refrigerant supercooling degree SC is larger or smaller than the target value, the processing advances to step S5.

In step S5, the opening degree of the third expansion valve 6 is changed. If the refrigerant supercooling degree SC at the outlet of the water heat exchanger 2 is larger than the target value, the opening degree of the third expansion valve 6 is increased and the processing advances to step S6. On the other hand, if the refrigerant supercooling degree SC at the outlet of the water heat exchanger 2 is smaller than the target value, the opening degree of the third expansion valve 6 is decreased and the processing advances to step S6.

In step S6, a refrigerant superheating degree SH at the suction port of the compressor 3 (a differential temperature between a temperature of the refrigerant sucked into the compressor 3, which is detected by the first temperature sensor 11*a* and a saturation temperature of a low-pressure refrigerant, which is detected by the fourth temperature sensor 11*d*) is compared with a target value to determine whether to change the opening degree of the first expansion valve 7. The first expansion valve 7 is controlled such that the refrigerant superheating degree SH at the suction port of the compressor 3 is kept at a preset target value. Accordingly, if the refrigerant superheating degree SH at the suction port of the compressor 3 is equal or close to the target value, the opening degree of the first expansion valve 7 is not changed and the processing advances to step S8. Further, if the refrigerant superheating degree SH at the suction port of the compressor 3 is larger or smaller than the target value, the processing advances to step S7.

In step S7, the opening degree of the first expansion valve 7 is changed. If the refrigerant superheating degree SH at the suction port of the compressor 3 is larger than the target value, the opening degree of the first expansion valve 7 is increased, and the processing advances to step S8. On the other hand, if the refrigerant superheating degree SH at the suction port of the compressor 3 is smaller than the target value, the opening degree of the first expansion valve 7 is decreased, and the processing advances to step S8.

In step S8, it is determined whether the injection control is being executed (control of the second expansion valve 8), that is, the second expansion valve 8 is being controlled. If the injection control is being executed, the processing advances to step S10. If the injection control is not being executed, the processing advances to step S9.

In step S9, it is determined whether a predetermined condition for starting the injection control is satisfied. In this embodiment, it is determined whether at least one of the ambient temperature measured by the fifth temperature sensor 11*e* and the inflow water temperature measured by the sixth temperature sensor 11*f* satisfies a predetermined condition. The predetermined condition means that the ambient temperature is below a predetermined temperature or the inflow water temperature exceeds a predetermined temperature. If at least one of the ambient temperature measured by the fifth temperature sensor 11*e* and the inflow water temperature measured by the sixth temperature sensor 11*f* satisfies a predetermined condition, the control of the second expansion valve 8 is started and the processing advances to step S10. If the ambient temperature measured by the fifth temperature sensor 11*e* and the inflow water temperature measured by the sixth temperature sensor 11*f* do not satisfy a predetermined condition, the processing returns to step S2.

In step S10, a refrigerant superheating degree SHd at the discharge port of the compressor 3 (a differential temperature between a discharge temperature of the compressor 3, which is detected with the second temperature sensor 11*b* and a condensing temperature of the water heat exchanger 2, which is calculated based on a pressure of a refrigerant discharged from the compressor 3 detected with the outdoor heat exchanger 12) is compared with a target value to determine whether to change the opening degree of the second expansion valve 8. The second expansion valve 8 is controlled such that the refrigerant superheating degree SHd at the discharge port of the compressor 3 is kept at a preset target value. Accordingly, if the refrigerant. superheating degree SHd at the discharge port of the compressor 3 is equal or close to the target value, the opening degree of the second expansion valve 8 is not changed and the processing advances to step S12. Further, if the refrigerant superheating degree SHd at the discharge port of the compressor 3 is larger or smaller than the target value, the processing advances to step S11.

In step S11, the opening degree of the second expansion valve 8 is changed. At the time of changing the opening degree of the second expansion valve 8, a refrigerant state is changed as follows. That is, if the opening degree of the second expansion valve 8 is increased, a flow rate of a refrigerant flowing through the injection circuit 13 increases. A heat exchange amount in the second internal heat exchanger 10 does not largely vary depending on the flow rate in the injection circuit 13. Thus, if the flow rate of a refrigerant flowing through the injection circuit 13 increases, a difference in refrigerant enthalpy (difference from point i to point j in FIG. 2) on the injection circuit 13 side in the second internal heat exchanger 10 is reduced to decrease enthalpy of an injected refrigerant (point j in FIG. 2). Accordingly, enthalpy of a refrigerant mixed with the injected refrigerant (point k in FIG. 2) is also deceased, resulting in reduction in discharge enthalpy (point a in FIG. 2) of the compressor 3. Then, the refrigerant superheating degree SHd at the discharge port of the compressor 3 reduces. In contrast, if the opening degree of the second expansion valve 8 is decreased, the discharge enthalpy (point a in FIG. 2) of the compressor 3 increases, and the refrigerant superheating degree SHd at the discharge port of the compressor 3 increases. Accordingly, the opening degree of the second expansion valve 8 is changed under control to increase at the time when the refrigerant superheating degree SHd at the discharge port of the compressor 3 is larger than a target value and to decrease at the time when refrigerant superheating degree SHd at the discharge port of the compressor 3 is smaller than a target value in step S11. Then, the processing advances to step S12.

In step S12, it is determined whether to terminate the injection control. In this embodiment, it is determined whether both of the ambient temperature measured by the fifth temperature sensor 11*e* and the inflow water temperature measured by the sixth temperature sensor 11*f* satisfy predetermined condition for terminating the injection control. If both of the ambient temperature measured by the fifth temperature sensor 11*e* and the inflow water temperature measured by the sixth temperature sensor 11*f* satisfy the predetermined condition, the injection control is terminated in step S13, and the processing returns to step S2. If the ambient temperature measured by the fifth temperature sensor 11*e* and the inflow water temperature measured by the sixth temperature sensor 11*f* do not satisfy the predetermined condition, the processing returns to step S2.

In the thus-prepared heat pump water heater outdoor unit 100, the injection circuit 13 for injecting a refrigerant to the compressor 3 is provided to thereby increase a condensing temperature of the water heat exchanger 2 and increase a refrigerant amount without excessively increasing the discharge refrigerant temperature of the compressor 3 or refrigerant superheating degree. Therefore, even in a heat pump water heater outdoor unit involving a high load and a much load change in the range from low-temperature (for example, 20° C.) water supply to high-temperature (for example, 60° C.) water supply in comparison with an air conditioner, a discharge refrigerant temperature of the compressor 3 can be kept stable at a predetermined value regardless of the load change at the low ambient temperature, and the heating/hot water supply ability can be prevented from lowering.

Further, the condensing temperature of the water heat exchanger 2 is calculated from the pressure measured by the pressure sensor 12 and the refrigerant superheating degree SHd at the discharge port of the compressor 3 can be determined with accuracy. Thus, if the second expansion valve 8 is controlled to adjust the refrigerant superheating degree SHd at the discharge port of the compressor 3 to be a predetermined value, the heat pump water heater outdoor unit 100 can be operated so as to satisfy a need for high hot water supply ability and high heating ability while ensuring its reliability, even at a low ambient temperature.

Further, the third expansion valve 6 is controlled so as to adjust the refrigerant supercooling degree SC at the outlet of the water heat exchanger 2 to be a predetermined value, making it possible to stabilize the refrigerant state in the water heat exchanger 2 regardless of the load change of the water heat exchanger 2 and stabilize the heat exchange performance of the water heat exchanger 2.

Moreover, the first expansion valve 7 is controlled so as to adjust the refrigerant superheating degree SH at the suction port of the compressor 3 to be a predetermined value, making it possible to optimize the superheating degree of the air heat exchanger 1 and stabilize the heat exchange performance of the air heat exchanger 1.

What is claimed is:

1. A heat pump water heater outdoor unit, comprising:

a compressor, a water heat exchanger for heat exchange between a refrigerant and water flowing through the water heat exchanger, a first decompression device, and an air exchanger for heat exchange between air and the refrigerant are connected with piping, the piping supplying heat absorbed from the air by the refrigerant flowing through the air heat exchanger to the water flowing through the water heat exchanger by the refrigerant flowing through the water heat exchanger;

a first internal heat exchanger provided between the water heat exchanger and the first decompression device for heat exchange between the refrigerant flowing between the water heat exchanger and the first decompression device and the refrigerant flowing between the air heat exchanger and the compressor;

an injection circuit branching off at a point between the first internal heat exchanger and the first decompression device to inject the refrigerant into the compressor through a second decompression device;

a second internal heat exchanger for heat exchange between the refrigerant flowing between the first internal heat exchanger and the first decompression device and the refrigerant flowing between the second decompression device and the compressor in the injection circuit;

a pressure sensor arranged for detecting a compressor discharge refrigerant pressure of the refrigerant discharged from the compressor;

a discharge refrigerant temperature sensor for detecting a discharge refrigerant temperature of the refrigerant discharged from the compressor;

an ambient temperature sensor for detecting an ambient temperature; and an inflow water temperature sensor for detecting an inflow water temperature of the water flowing into the water heat exchanger; and a controller configured to control an opening degree of the second decompression device based on at least one condition, wherein the controller is further configured to start an injection control using the second decompression device, after the second decompression device is set to initial value and a predetermined time elapses and when the at least one condition is satisfied, the at least one condition being:

(a) the ambient temperature, measured with the ambient temperature sensor, falls below a first predetermined value; or (b) the inflow water temperature, measured with the inflow water temperature sensor, exceeds a second predetermined value and; in addition, after one of condition (a) or condition (b) is met, the controller is configured to perform controlling the opening degree of the second decompression device based on the comparison of a target temperature difference with a temperature difference between the temperature calculated form the discharged refrigerant pressure of the compressor detected by the pressure sensor and the discharged refrigerant temperature detected by the discharged refrigerant temperature sensor.

2. The heat pump water heater outdoor unit of claim 1, further comprising:

a third decompression device provided between the water heat exchanger and the first internal heat exchanger; and a condenser liquid refrigerant temperature sensor for detecting a water heat exchanger outflow refrigerant temperature of the refrigerant flowing out of the water heat exchanger, wherein the third decompression device is controlled by the controller so that a condensing temperature of the water heat exchanger, which is calculated from the compressor discharge refrigerant pressure, and a refrigerant supercooling degree of the water heat exchanger, which is calculated based on the water heat exchanger outflow refrigerant temperature, are kept at predetermined values.

3. The heat pump water heater outdoor unit of claim 1, further comprising:

an evaporator liquid refrigerant temperature sensor for detecting an air heat exchanger inflow refrigerant temperature of the refrigerant flowing into the air heat exchanger; and an intake refrigerant temperature sensor for detecting an intake refrigerant temperature of the refrigerant drawn by the compressor, wherein the first decompression device is controlled by the controller so that a superheating degree of the refrigerant at a suction port of the compressor is kept at a predetermined value, and the superheating degree of the refrigerant at the suction port of the compressor is calculated based on the air heat exchanger inflow refrigerant temperature and the intake refrigerant temperature.

4. The heat pump water heater outdoor unit of claim 1, wherein the second decompression device is controlled by the controller so that a superheating degree of the refrigerant at a discharge port of the compressor is kept at a predetermined value, the superheating degree of the refrigerant at the discharge port of the compressor is calculated based on the discharge refrigerant temperature and a condensing temperature of the water heat exchanger, and the condensing temperature of the water heat exchanger is calculated from the compressor discharge refrigerant pressure.

5. The heat pump water heater outdoor unit of claim 1, wherein under a state in which the condensing temperature of the water heat exchanger calculated from the compressor discharge refrigerant pressure is lower than a target condensing temperature of the water heat exchanger, which is determined based on a preset water temperature, when a difference between the condensing temperature and the target condensing temperature is larger than a predetermined temperature difference, an operation frequency of the compressor is increased, and when the difference between the condensing temperature and the target condensing temperature is smaller than the predetermined temperature difference, the operation frequency of the compressor is decreased.

6. The heat pump water heater outdoor unit of claim 1, wherein the refrigerant is R410A or R407C.

7. A heat pump water heater comprising the heat pump water heater outdoor unit of claim 1.

8. The heat pump water heater outdoor unit of claim 2, further comprising:

an evaporator liquid refrigerant temperature sensor for detecting a heat exchanger inflow refrigerant temperature of the refrigerant flowing into the air heat exchanger; and an intake refrigerant temperature sensor for detecting an intake refrigerant temperature of the refrigerant drawn by the compressor, wherein the first decompression device is controlled by the controller so that a superheating degree of the refrigerant at a suction port of the compressor is kept at a predetermined value, and the superheating degree of the refrigerant at the suction port of the compressor is calculated based on the air heat exchanger inflow refrigerant temperature and the intake refrigerant temperature.

9. The heat pump water heater outdoor unit of claim 2, wherein the second decompression device is controlled by the controller so that a superheating degree of the refrigerant at a discharge port of the compressor is kept at a predetermined value, the superheating degree at the discharge port of the compressor is calculated based on the discharge refrigerant temperature and a condensing temperature of the water heat exchanger, and the condensing temperature of the water heat exchanger is calculated from the compressor discharge refrigerant pressure.

10. The heat pump water heater outdoor unit of claim 2, wherein under a state in which the condensing temperature of the water heat exchanger calculated from the compressor discharge refrigerant pressure is lower than a target condensing temperature of the water heat exchanger, which is determined based on a preset water temperature, when a difference between the condensing temperature and the target condensing temperature is larger than a predetermined temperature difference, an operation frequency of the compressor is increased, and when the difference between the condensing temperature and the target condensing temperature is smaller than the predetermined temperature difference, the operation frequency of the compressor is decreased.

11. The heat pump water heater outdoor unit of claim 2, wherein the refrigerant is R410A or R407C.

12. A heat pump water heater comprising the heat pump water heater outdoor unit of claim 2.

13. The heat pump water heater outdoor unit of claim 3, wherein the second decompression device is controlled by the controller so that a superheating degree of the refrigerant at a discharge port of the compressor is kept at a predetermined value, the superheating degree is calculated based on the discharge refrigerant temperature and a condensing temperature of the water heat exchanger, and the condensing temperature of the water heat exchanger is calculated from the compressor discharge refrigerant pressure.

14. The heat pump water heater outdoor unit of claim 3, wherein under a state in which the condensing temperature of the water heat exchanger calculated from the compressor discharge refrigerant pressure is lower than a target condensing temperature of the water heat exchanger, which is determined based on a preset water temperature, when a difference between the condensing temperature and the target condensing temperature is larger than a predetermined temperature difference, an operation frequency of the compressor is increased, and when the difference between the condensing temperature and the target condensing temperature is smaller than the predetermined temperature difference, the operation frequency of the compressor is decreased.

15. The heat pump water heater outdoor unit of claim 3, wherein the refrigerant is R410A or R407C.

16. A heat pump water heater comprising the heat pump water heater outdoor unit according to claim 3.

17. The heat pump water heater outdoor unit of claim 4, wherein under a state in which the condensing temperature of the water heat exchanger calculated from the compressor discharge refrigerant pressure is lower than a target condensing temperature of the water heat exchanger, which is determined based on a preset water temperature, when a difference between the condensing temperature and the target condensing temperature is larger than a predetermined temperature difference, an operation frequency of the compressor is increased, and when the difference between the condensing temperature and the target condensing temperature is smaller than the predetermined temperature difference, the operation frequency of the compressor is decreased.

18. The heat pump water heater outdoor unit of claim 4, wherein the refrigerant is R410A or R407C.

19. A heat pump water heater comprising the heat pump water heater outdoor unit of claim 4.

* * * * *